US006167961B1

(12) United States Patent
Pollard et al.

(10) Patent No.: US 6,167,961 B1
(45) Date of Patent: Jan. 2, 2001

(54) SMALL DIAMETER RUN IN WHIPSTOCK AND METHOD FOR SETTING IN LARGE DIAMETER CASING

(75) Inventors: Michael E. Pollard; Britt O. Braddick, both of Houston, TX (US)

(73) Assignee: TIW Corporation, Houston, TX (US)

( * ) Notice: Under 35 U.S.C. 154(b), the term of this patent shall be extended for 0 days.

(21) Appl. No.: 09/315,876

(22) Filed: May 20, 1999

(51) Int. Cl.[7] ..... E21B 7/08; E21B 29/16

(52) U.S. Cl. ..... 166/117.6; 160/298; 160/313; 160/55.6

(58) Field of Search ..... 166/117.5, 117.6, 166/298, 313, 55.6

(56) References Cited

U.S. PATENT DOCUMENTS

| | | | | |
|---|---|---|---|---|
| 4,852,666 | * | 8/1989 | Brunet et al. | 175/61 |
| 5,531,271 | * | 7/1996 | Carter | 166/117.6 |
| 5,551,509 | | 9/1996 | Braddick | 166/55.7 |
| 5,595,247 | | 1/1997 | Braddick | 166/297 |
| 5,704,437 | * | 1/1998 | Murray | 175/61 |
| 5,769,167 | | 6/1998 | Braddick | 166/382 |

* cited by examiner

*Primary Examiner*—David Bagnell
*Assistant Examiner*—Jennifer R. Dougherty
(74) *Attorney, Agent, or Firm*—Browning Bushman

(57) ABSTRACT

A whipstock assembly 10 for setting within a casing C on an anchor A diverts a cutting mill M to cut a window in the casing. The whipstock assembly is passed through a restriction positioned above the location where the whipstock assembly is set, is lowered past the restriction in a run in position, and is set within the casing in a set position. The whipstock assembly includes an upper whipstock body 20 having a ramp surface 22, 26, a middle lower whipstock body 60 having a concave guiding face 72, and a lower whipstock body 110 having a concave whipstock diversion face 112. A lower hinge member 118 is provided for positioning the concave whipstock diversion face for diverting the cutting mill, and at least one whipstock positioning member 80, 100 engages the casing when in the set position for positioning the middle whipstock body guiding face. Accordingly the method of the invention, the cutting mill and at least a portion of the a downhole motor may be positioned adjacent the guiding face of the middle whipstock body when initiating rotation of the cutting mill. The whipstock and method of the present invention are particularly well suited for conducting a thru tubing operation, with the tubing OD being less than the ID of the casing which the whipstock assembly is set.

22 Claims, 5 Drawing Sheets

SMALL DIAMETER RUN IN WHIPSTOCK AND METHOD FOR SETTING IN LARGE DIAMETER CASING

FIELD OF THE INVENTION

The present invention relates to whipstocks and methods for setting a whipstock of the type commonly used for setting in a casing, cutting a window in the casing and then drilling a lateral from the casing in a formation. More particularly, this invention relates to a relatively small diameter whipstock which may be run in the well and then reliably set in a large diameter casing while minimizing the risk of the window mill rotating out of engagement with the concave whipstock surface. The present invention is thus well suited for a "thru tubing" operation wherein the whipstock is run in the well through a small tubing and is set within a large diameter casing to perform the window cutting operation and the drilling of a lateral. The whipstock may also then be retrieved to the surface through the small diameter tubing.

BACKGROUND OF THE INVENTION

A whipstock is a downhole diversion tool inserted into a well bore and used for deflecting a drill bit, mill, or other tool in a direction that is angularly offset with respect to the orientation of an original well bore. The deflected mill may thus establish a new or additional drilling path. A whipstock set in a casing string on an anchor thus provides an angled whipstock face at the desired depth in the well bore to conduct side track or lateral drilling operations thru the casing string.

It is frequently desirable to cut or mill a window in a casing string that includes therein a smaller diameter tubing or other significant restriction that is positioned above the desired position of the casing window. Since the removal of the tubing string or the removal of this restriction may require considerable rig time and expense, "thru tubing" whipstock assemblies have been developed for passing through a tubing string and then setting in the casing string at the desired depth for milling or cutting the window in the casing. Once the window has been properly cut in the casing, a side track or lateral drilling operation may proceed, using the whipstock face as the diversion tool for the drilling bit. In some applications, the whipstock face is oriented to drill the lateral in a desired azimuthal direction relative to the casing. Thru tubing whipstocks are disclosed in U.S. Pat. Nos. 5,595,247 and 5,769,167. A suitable anchor at the lower end of a whipstock for setting within the casing is disclosed in U.S. Pat. No. 5,595,247.

In many thru tubing whipstock operations, the diameter of the whipstock body and the diameter of the window cutting mill effectively prevent the mill, once positioned against the whipstock concave deflecting surface, from rolling out of engagement with this concave surface during the window cutting operation. In other applications, however, the restriction above the location where the whipstock is set is sufficiently small that the combined diameter of both the whipstock body which is passed thru this restriction and the diameter of the mill which is also passed through this restriction for engaging the whipstock are less than the interior diameter of the casing in which the whipstock is set. The mill may still be used to cut a window in the casing since the lower end of the whipstock is spaced radially from the side wall of the casing opposite the circumferential location where the window is to be cut. In these applications, however, the mill may tend to rotate or roll out of engagement with the concave whipstock surface, so that the mill can then become positioned on the side of the whipstock body rather than against the front concave face of the whipstock body, thereby effectively terminating the intended window cutting operation. Moreover, special problems are presented when attempting to reliably set and reliably retrieve a whipstock in a large diameter casing when the whipstock body has a diameter markedly less than the interior diameter of the casing.

The disadvantages of the prior art are overcome by the present invention, and an improved whipstock and method are hereinafter disclosed which allow a relatively small diameter whipstock to be run into a well, set within a relatively large diameter casing, reliably mill a window in the casing by engaging a cutting mill with the whipstock, drill a lateral into the formation and, if desired, thereafter retrieve the whipstock to the surface.

SUMMARY OF THE INVENTION

A whipstock assembly for setting in a casing on an anchor includes a lower whipstock body having a concave whipstock diversion face for diverting a cutting mill to cut a window in the casing, a lower hinge member for pivoting the lower whipstock body with respect to the anchor, a middle whipstock body moveable relative the lower whipstock body, at least one whipstock positioning member, and an upper whipstock body moveable relative to the middle whipstock body. The whipstock assembly may be run into a wellbore through a substantial restriction positioned above the location where the whipstock assembly is to be set, and accordingly the whipstock assembly is movable from a run in position for passing through the restriction to a set position for cutting the window in the casing. The middle whipstock body has a concave guiding face for guiding the cutting mill when in the set position, and the upper whipstock body has a ramp surface for moving the cutting mill when in the set position into engagement with the middle whipstock guiding face. The whipstock positioning member engages the casing when in the set position at a location circumferentially opposite the location wherein the window will be cut, thereby positioning the middle whipstock body for guiding the cutting mill.

In a preferred embodiment, the middle whipstock body concave guiding face has a substantially zero degree taper when in the set position, such that the middle whipstock body may guide both the cutting mill and at least a portion of the a downhole motor used to rotate the cutting mill. An upper hinge member may be used for pivotally connecting a lower end of the upper whipstock body and upper end of the middle whipstock body. One or more whipstock positioning members may be pivotally connected to the middle whipstock body for reliably positioning the whipstock assembly when in the set position. A setting tool may be used to move a rod which activates the hinge member and the one or more whipstock positioning members to the set position. A stop member may be provided for preventing movement of the whipstock positioning member with respect to the middle whipstock body when in the set position.

According to the method of the invention, the whipstock assembly is lowered in the wellbore past the restriction while in the run in position. The whipstock assembly is then secured to on anchor already positioned within the casing. The lower whipstock body, the middle whipstock body, and the upper whipstock body are each moved from a run in position to a set position, with the whipstock positioning member engaging the casing to position the middle whipstock body. A cutting mill is then lowered for engagement with the ramp surface on the upper whipstock body, and thereafter lowered to a position axially adjacent the middle whipstock body guiding face. The cutting mill may then be rotated while positioned axially adjacent the middle whipstock body guiding face, and the rotating cutting mill then lowered for engagement with the lower whipstock body diversion face for cutting the window in the casing.

According to a preferred embodiment of the invention, a lower end of the upper whipstock body and an upper end of the middle whipstock body may be pivotally connected. A pair of whipstock positioning members may be provided each for engaging the casing at a location circumferentially opposite the location where the window will be cut. Each whipstock positioning member may be pivotally connected to the middle whipstock body. Both the lower whipstock body and the lower hinge member may engage the casing when in the set position. A setting tool may be used to move the whipstock assembly to the set position. The cutting mill may be raised before activating the downhole motor to insure that the cutting mill is out of engagement with the lower whipstock body diversion surface when the mill is first rotated. The rotating mill may be then be lowered for engagement with the whipstock diversion surface.

It is an object of the present invention to provide an improved whipstock assembly and an improved method for cutting a window in a casing after passing the whipstock assembly through a substantial restriction in a wellbore. The whipstock assembly and the method of the present invention are particularly well suited for use in thru tubing operations, wherein a tubing having an outer diameter less than an inner diameter of the casing is positioned within a well, and the whipstock assembly is lowered through the tubing while in a run in position then lowered below the tubing and set within a casing for diverting a mill to cut a window in the casing.

It is a related object of the present invention to improve the reliability of cutting a window in a casing after passing a whipstock assembly through a restriction positioned above the location where the window is cut. The whipstock assembly is provided with a concave guiding face for guiding the cutting mill prior to engaging the concave whipstock diversion face which diverts the cutting mill to cut the window in the casing.

It is a significant feature of the present invention that the whipstock assembly may be reliably set within a large diameter casing after passing through a small diameter restriction positioned above the location where the whipstock assembly is set. The whipstock assembly may be retrievable so that, after cutting the window in the casing and drilling a lateral from the wellbore, the whipstock assembly may be returned to the surface by raising the whipstock assembly through the restriction.

It is an advantage of the present invention that the whipstock may include a ratchet mechanism which ensures that the whipstock assembly remains in the set position until it is intentionally disabled for releasing the whipstock assembly.

It is another advantage of the present invention that the lower end of the upper body of the whipstock assembly may be designed to remain out of engagement with the casing, thereby enhancing the reliability of the whipstock assembly moving from the run in position to the set position.

Yet another advantage of the invention is that the whipstock positioning member may be provided with a stop surface for limiting movement of the whipstock upper body relative to the whipstock middle body.

Still another advantage of the invention is that the reliability of the whipstock setting operation is enhanced by utilizing a rod to move the whipstock assembly components to the set position, with the rod first initiating movement of the lower components of the whipstock assembly and subsequently initiating movement of upper components of the whipstock assembly.

These and further objects, features and advantages of the present invention will become apparent from the following detailed description, wherein reference is made to the figures in the accompanying drawings.

DETAILED DESCRIPTION OF PREFERRED EMBODIMENTS

FIG. 1 consists of FIGS. 1A, 1B, 1C, 1D, 1E and 1F, which are successively lower portions of suitable whipstock assembly 10 according to the present invention. The whipstock assembly 10 as shown in FIG. 1 is in the run in position. In the following description, the whipstock assembly 10 is discussed for positioning within a vertical wellbore. Those skilled in the art will appreciate that the whipstock assembly and method of the present invention are conventionally used in inclined or deviated wellbores, although for ease of explanation the wellbore axis for following description will be considered vertical. Also, those skilled in art will appreciate that the terms "upper" and "lower" are used herein with reference to such typical orientation, and should not be construed in the limiting sense.

Figure 1A:
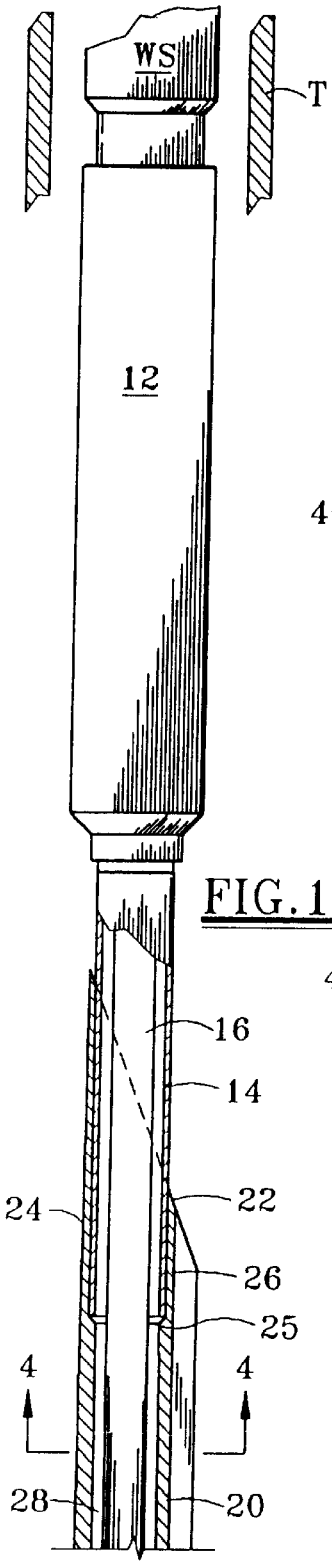
FIGS. 1A, 1B, 1C, 1D, 1E and 1F illustrate successively lower portions of a whipstock assembly, partially in cross section, in the run in position for passing through a restriction in a wellbore.
Figure 1B:
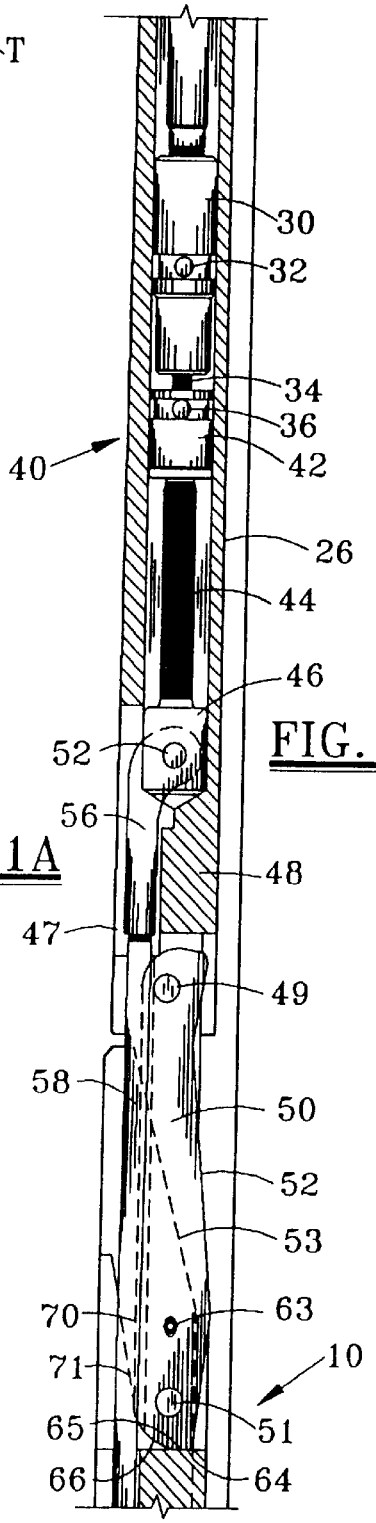
Figure 1C:
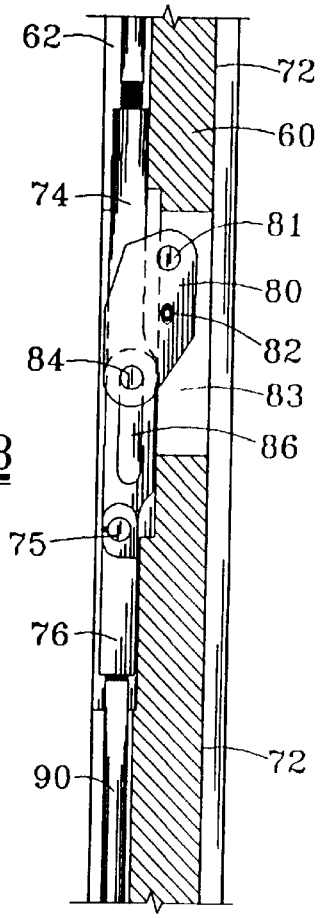
Figure 1D:
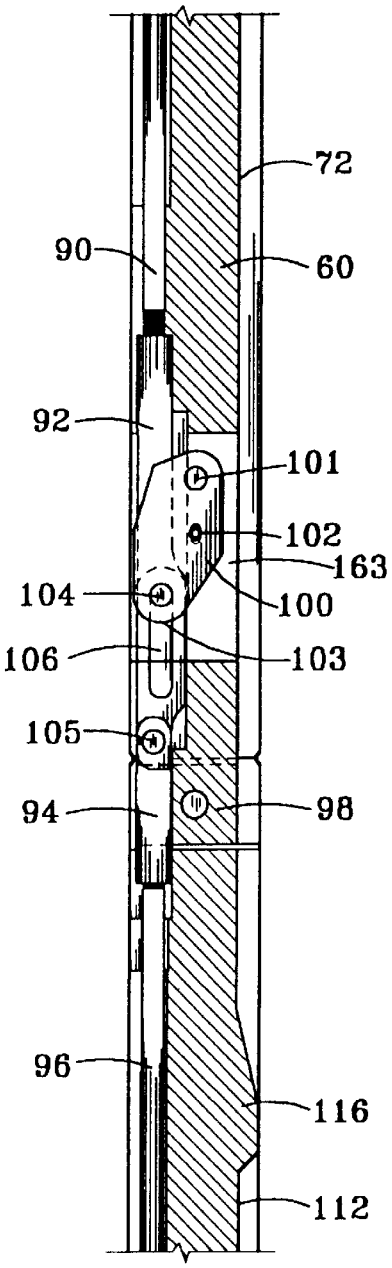
Figure 1E:
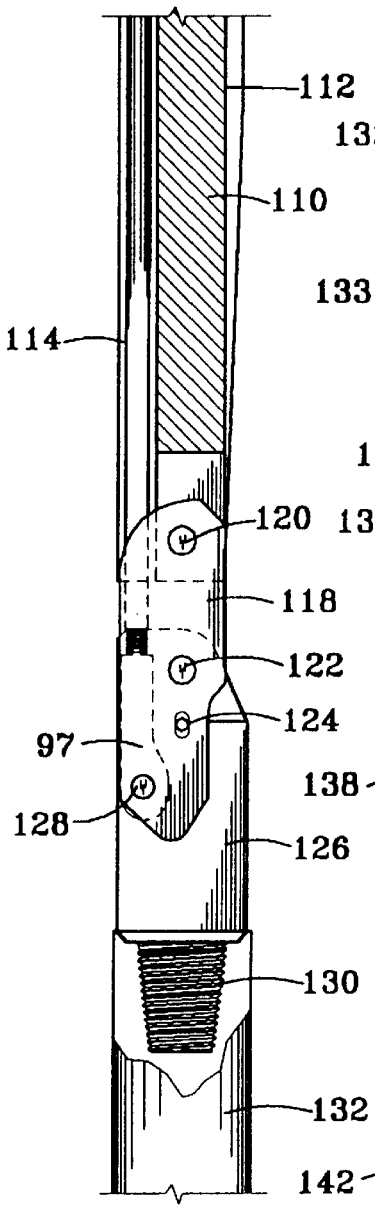
Figure 1F:
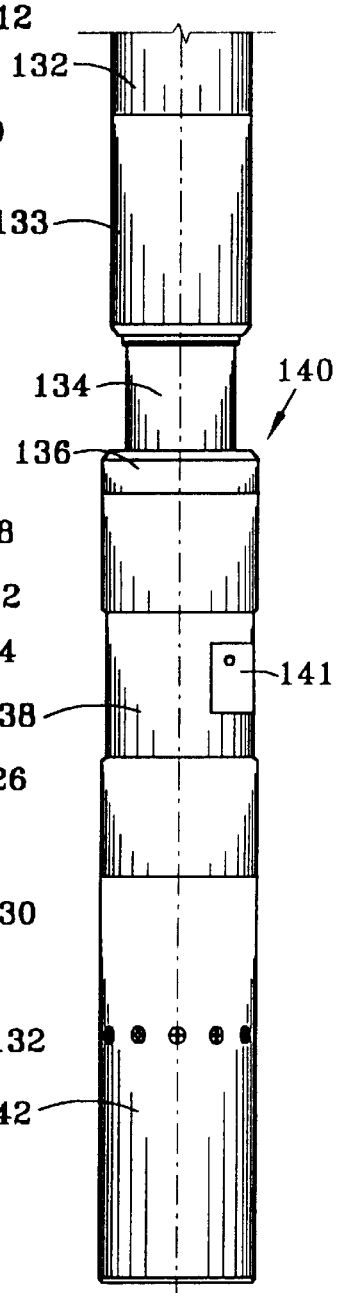

The primary components of the whipstock assembly are a setting tool 12 shown in FIG. 1A, and upper whipstock body 20 shown in FIGS. 1A, 1B, a middle whipstock body 60 shown in 1B, 1C and 1D, a lower whipstock body shown in FIGS. 1D and 1E, and a latch assembly 140 shown in FIGS. 1E and 1F. According to the present invention, this entire assembly may be lowered into a wellbore through a restriction, which in a typical application will be a tubing string T, a portion which is shown in FIG. 1A. Once passed through the lowermost end of the tubing string T, the whipstock assembly 10 of the present invention may be set within a casing C, which is shown in FIGS. 2A–2D. Those skilled in the art will appreciate that the outer diameter of the tubing T is less, and in many applications is significantly less, than the inner diameter of the casing C. The whipstock assembly of the present invention is thus well suited for a thru tubing application wherein the whipstock assembly is passed through a small diameter tubing and out the lowermost end of the small diameter tubing, is set within a much large diameter casing for cutting a window in the casing, and then optionally retrieved to the surface by passing upward through the tubing string T. A suitable embodiment in the present invention may include a upper whipstock body, a middle whipstock body, and a lower whipstock body which each have a nominal diameter of from 3.5 to 3.8 inches, and that the whipstock assembly may be set within a casing having an inner diameter of from 8 inches to 9 inches.

Those skilled in the art will appreciate that a wellbore may have significant restrictions other than a tubing string already in the well, and that considerable cost savings may be realized by passing a whipstock assembly through the small diameter restriction and then setting the whipstock assembly below the restriction in a large diameter casing. Those skilled in the art will thus appreciate that restrictions other than a tubing string may exist within a well such that it is beneficial to pass the whipstock assembly of the present invention through the restriction and then set the whipstock assembly in a casing having an interior diameter much larger than the restriction. Accordingly, the term "restriction" as used herein means a passageway whose average diameter is less than approximately 65% of the interior diameter of the casing in which the whipstock assembly is set, more typically it is in the range of from about 40% to 65% of the diameter of the casing string in which the whipstock assembly is set.

The whipstock assembly 10 may be passed through the tubing string T in the wellbore by lowering the assembly from a work string WS as shown in FIG. 1A. A suitable setting tool 12 according to the present invention is a hydraulically activated setting tool of the type well know in the art. The setting tool 12 includes an outer sleeve 14 and an inner rod 16 which is movable relative to the outer sleeve upon actuating the setting assembly. More particularly, an exemplary actuation of the setting tool raises the rod 16 with respect to the sleeve 14, or alternatively pushes the sleeve 14 downward relative to the rod 16. A lower end of the setting sleeve 14 engages a shoulder surface 25 on the upper whipstock body 20 and the rod 16 extends downward within the bore 28 of the upper body to the connector 30.

Figure 4:
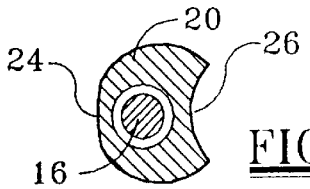
FIG. 4 is a cross section taken along lines 4—4 in FIG. 1A.

Referring to FIGS. 1A, 1B and 4, the upper whipstock body 20 has top concave ramp surface 22, which is preferably angled at about 15 degrees relative to a central axis of the whipstock assembly, a concave ramp surface 26 which is discussed in further detail below, and a casing engaging surface 24 also discussed further below. The concave ramp surface 26 of the upper whipstock body may be considered the front surface of the upper body, and accordingly the casing engaging surface 24 which is radially opposite the front or high side surface 26 may be considered the back or low side surface of the upper whipstock body. The whipstock back surface 24 of the whipstock body may be machined as shown in FIG. 4 to match the ID of the casing in which the whipstock will be set, so that the upper portion of the upper whipstock body 20 will be in planar engagement with the casing C when the whipstock assembly is set.

The connector 30 may be shear pinned in the run in position to the upper whipstock body 20 by pin 32. A shear stud 34 may be extend downward from the connector 30 and to a ratchet assembly 40. The ratchet assembly 40 includes a ratchet retainer and ratchet ring or subassembly 42 and a ratchet assembly mandrel 44. The ratchet assembly is discussed further below, and is of the type known in the art for use in whipstock assemblies to retain a set whipstock in that condition. A guide body 46 is provided at the lower end of the bore 28 in the upper body, and as explained subsequently is movable within the bore of the upper body. The lowermost end 48 of the upper body 20 not need contain a bore, but may contain a backside slot 47 for allowing movement of the upper link 56.

The lower end of the upper body 20 is pivotally connected with the upper end of the middle whipstock body 60 by an upper hinge member 50. The hinge member 50 is pivotally connected at 49 to the upper whipstock body and similarly is pivotally connected at 51 to the middle whipstock body. The upper hinge member 50 includes a front or high side surface 52, and a back or low side surface 70 for engagement with a stop surface 71 on the middle whipstock body 60. A shear pin 63 is provided for maintaining the position of the upper hinge member 50 in the run in position while the whipstock assembly 10 is lowered in the well. The lower end of the hinge member 50 includes a curved surface 66 and a short planar surface 64. One of these surfaces is continually in engagement with the planar surface 65 in the upper end of the middle whipstock body 60. The engaging surfaces 64 and 65 are positioned as show in FIG. 1B to the right of the centerline of the pin 51, thereby ensuring that, when the shear pin 63 is severed, the upper hinge member 50 can only rotate in the desired direction to achieve setting of the whipstock assembly. The rotational force which rotates the hinge member 50 is downward through the sleeve 14 and the upper whipstock body 20 then to the pin 49, which as shown in FIG. 1B is slightly to the left of pin 51, thus achieving rotation of the hinge member 50. The uppermost end of the hinge member 50 also includes a concave ramp surface 52 which may be parallel with the concave ramp surface 52 of the upper hinge member when the whipstock assembly is in the set position. The middle whipstock body has a concave guiding surface 72 which extends downward from the lowermost end of ramp surface 53 to the lower end of the middle whipstock body 60.

The middle whipstock body 60 also has aback side slot 62 for receiving the upper rod 58 and the middle rod 90 as discussed below.

Upper link 56 is pivotally connected at 52 to guide body 46. Upper rod 58 extends down from link 56 into slot 62. The lower end of the rod is connected to an upper middle link member 74. A lower middle link member 76 is pivotally connected at 75 to the upper middle link 74, and middle rod 90 extends downward from the lower middle link 76. A whipstock positioning member 80 is pivotally connected to the middle whipstock body 60 at pin 81 and is retained in the run in position by shear pin 82. The middle whipstock body 60 thus has a narrow through slot 83 extending from the concave surface 72 to the opposing back surface of the middle whipstock body. The whipstock positioning member 80 is also pivotally connected to the upper middle link 74 by pin 84, which slides within slot 86 provided in the upper middle link 74. The lower end of the middle rod 90 is similarly connected to a similar assembly comprising another upper middle link 92, a lower middle link 94, and a pivot connection 105 between these members. Another whipstock positioning member 100 is pivotally connected at 101 to a lower end of the middle whipstock body 60. The pivot member 100 is moveable within through slot 163, and is retained in the run in position by shear pin 102. Pin 104 is connected to the positioning member 100, and slides within the slot 106. The lower rod 96 extends downward from the lower middle link 94 and, when in the run in position, fits within back slot 114 in the lower whipstock body 110. The lower link 97 is threadably connected to the lower rod 90 and pivots about pin 128 mounted on lower connector 126.

A conventional tongue in groove hinge connector 98 is provided for pivotally connecting the lowermost end of the middle body 60 with the uppermost end of the lower whipstock body 110. The lower whipstock body 1 10 includes a front concave whipstock diversion face 112 and a rear slot 114 for receiving the lower rod 96. A conventional lug 116 is provided at the uppermost end of the lower whipstock body 110. A lower hinge member 118 is pivotally connected at 120 to the lowermost end of the lower whipstock body 110 and is pivotally connected at 122 to a lower connector 126. Connector 126 includes threads 130 for mating with the latch assembly 140. The lower hinge member pivots about the axis of pin 122 mounted on lower connector 126. The lower hinge member 118 is retained in the run in position by shear pin 124.

A latch assembly 140 is a type conventionally provided for securing the whipstock assembly to an anchor which is set in a well, and includes an upper bushing 132 with threads for mated engagement with threads 130, retaining nut 133 surrounding orientation sub 134, overshot bushing 136 in threaded engagement with overshot 138, and lower latch housing 142. A key 141 is provided for securing the latch housing 142 in a selected position so that when the whipstock assembly is secured to the anchor, the faces of the whipstock assembly which engage the mill will be properly aligned.

Figure 3:
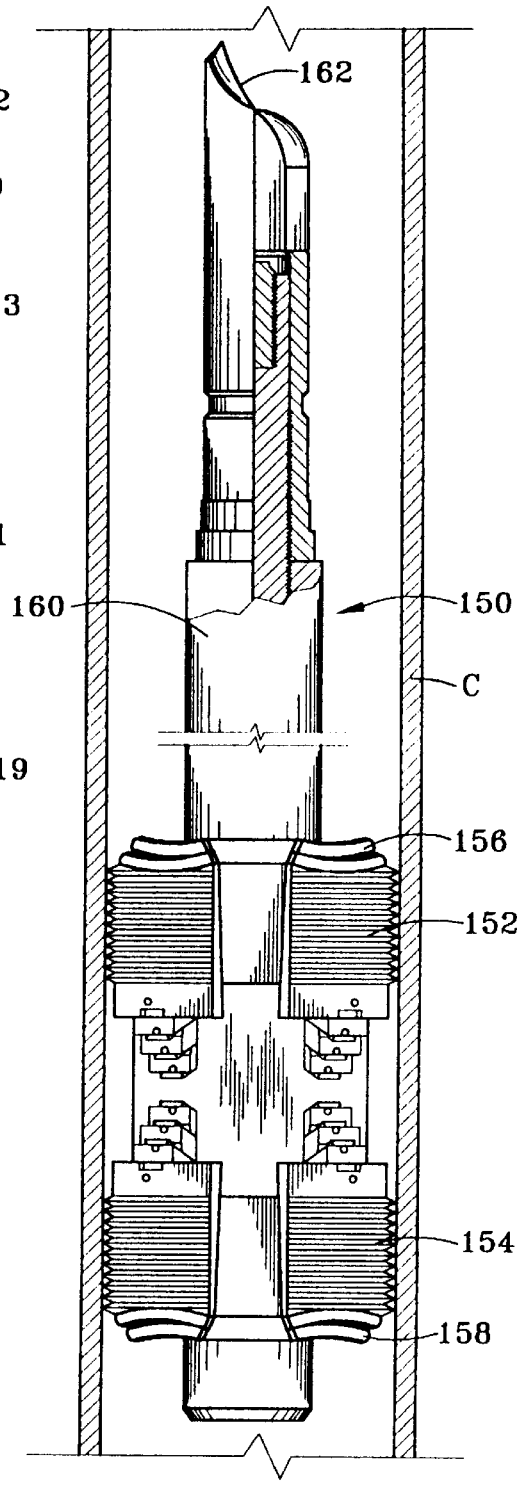
FIG. 3 illustrates an exemplary anchor for securing the position of the whipstock assembly within a casing.

The whipstock assembly 10 discussed above may thus be lowered in the well in the set position until the latch assembly 140 is secured to a conventional anchor, such as anchor 150 shown in FIG. 3 set within the casing C. The anchor 150 includes a plurality of upper slips 152 and a plurality of lower slips 154. Each of these slips may be moved radially outward into engagement with the inner wall of casing C by a plurality of circumferentially spaced wedge members 156 and 158, respectively. Sub 160 extends upward from the slips, and the upper end of the sub 160 is provided with a orientation surface 162 which cooperates with the latch assembly 140 to achieve the desired orientation of the whipstock assembly in the well so that the mill will drill a window and a lateral at the desired azimuth. Further details with respect to suitable anchor assembly 150 are discussed in U.S. Pat. No. 5,595,247, hereby incorporated by reference.

Once the whipstock assembly position has been secured on the anchor 150, the whipstock assembly is moved from the run in position to the set position. To initiate this action, fluid may be pumped through the work string WS to activate the hydraulic setting tool 12, which then raises the rod 16 with respect to the sleeve 14 and thus the upper whipstock body 20. Those skilled in the art will appreciate that the hydraulic setting tools of this type are well known in the prior art, and thus the details of the setting tool 12 are not discussed herein. Also, those skilled in the art will appreciate that other types of setting tools may be used to activate the rod 16 for setting the whipstock assembly. If the whipstock assembly is lowered in the well from a wire line rather than a work string, an explosive charge setting tool may be used to move the rod 16 to set the whipstock assembly.

In a preferred embodiment of the invention, the activation of the setting tool 12 first shears the pin 32 which interconnects the connector 30 and the upper whipstock body 20, thereby allowing movement of the rod 16. Movement of the rod 16 thereafter preferably activates components of the whipstock assembly starting with the lowermost end of the whipstock assembly 10 and moving upward to set the whipstock assembly. Thus the activation of the setting tool may next shear the member 124 which retains the lower pivot member 118 in the run in position. Further raising of the rod 114 will thus rotate the pivot member in the clockwise direction from the run in position as shown in FIG. 1E to the set position as shown in FIG. 2D. Once flilly rotated to the set position, movement of the pivot member 118 brings the lower whipstock body 110 into engagement with the casing C. More particularly, a concave surface 112 on the whipstock assembly 110 runs out at point 113, and a lower surface 111 on the whipstock assembly below point 113 is configured for planar engagement with the casing C, as shown in FIG. 2D. Also, the pivot member 118 may include a rearward casing engaging surface 127 for engaging the casing at a location opposite the location where the window will be cut. If desired, both the surface 111 of the whipstock assembly 110 and a front surface 119 of the pivot member 118 may engage the casing.

Figure 6:
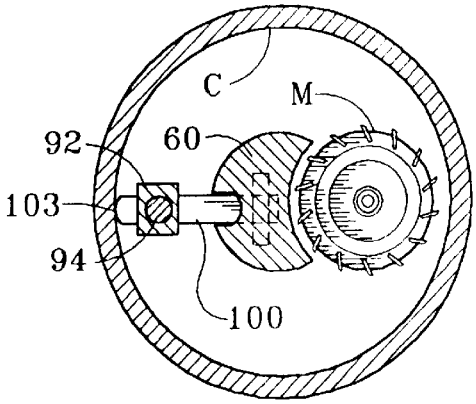
FIG. 6 is a cross section taken along lines 6—6 in FIG. 2C.

Raising of the rod 96 causes the pin member 104 as shown in FIG. 1D to engage in the bottom of the slot 106 in the upper middle link 92. In a preferred embodiment, the pin 104 bottoms out on this slot after rotation of the pivot member 118 is initiated, but prior to movement of the rod 96 causing the pivot member 118 to reach its fully set position. Thus as the pivot member 118 is in the process of moving toward the set position, the pin 104 bottoms out in the slot 106 so that further upward movement of the rod 90 shears the pin 102 which holds the lower whipstock positioning member 100 in the run in position. After shearing the pin 102, the lower whipstock positioning member 100 will then begin to rotate about pin 101 in the clockwise direction, moving from the position as shown in FIG. 1D to the position as shown in FIG. 2C. The whipstock positioning member 100 has a rearward surface 103 for engaging the casing C, thereby positioning the lower end of the middle whipstock body 60 in its desired position within the casing C. As shown in FIG. 6, the whipstock positioning member 100 is a plate like member which is straddled by the lower end of the upper middle link 92, and accordingly each end of the pin 104 moves downward in a respective slot 106 in the member 92 during the setting operation. Referring to FIG. 2B, upward movement of the rod 90 also moves the upper whipstock positioning member 80 from the position as shown in FIG. 1C to the position as shown in FIG. 2B. This movement is similarly accomplished by first raising the upper middle link 74 so that pin 84 bottoms out in the slot 86, at which point pin 82 which retains the upper positioning member 80 in the run in position is sheared. The upper positioning member 80 then rotates in the clockwise direction about the axis 81 until the rear surface 83 engages the casing.

Movement of the upper and the lower whipstock positioning member is controlled by limiting upward movement of the rod 96, which in turn occurs when surface 119 and 127 on the lower hinge 118 engage opposing sides of the casing C. The position of the guiding face 72 on the middle whipstock body with respect to the high side of the casing is thus determined by the limit of the upward travel of rod 96. Each of the positioning members may also include a stop surface, such as stop surface 99 on positioning member 100 (see FIG. 2C), which would engage the upper surface of the slot in the whipstock body to prevent over-rotation of the positioning member.

When the upper whipstock member 80 moves from the run in position as shown in FIG. 1C to the set position as shown in FIG. 2B, the middle whipstock body 60 is inherently moved toward the center of the casing C. As discussed above, a downward force is transmitted through the upper body to move the pivot member from the run in position as shown in FIG. 1B to the set position as shown in FIG. 2B. The desired movement is accomplished by first shearing the pin 63 so that the lower end of the upper pivot 50 moves toward the center of the casing, thereby causing the curved surface 66 at the lower end of the upper pivot member 50 to come into engagement with the upper surface 65 of the middle whipstock body 60. The positioning of the middle whipstock body 60 with respect to the upper whipstock body 20 is limited when the back surface 70 of the upper pivot member 50 engages the stop surface 71 on the middle whipstock body. At this set position, the concave ramp surface 53 at the upper end of the middle whipstock body 60 cooperates with the ramp surface 52 to serve as the transition from the lowermost end of the concave surface 26 of the upper whipstock body 20 to the guide surface 72 on the middle whipstock body 60.

Figure 2A:
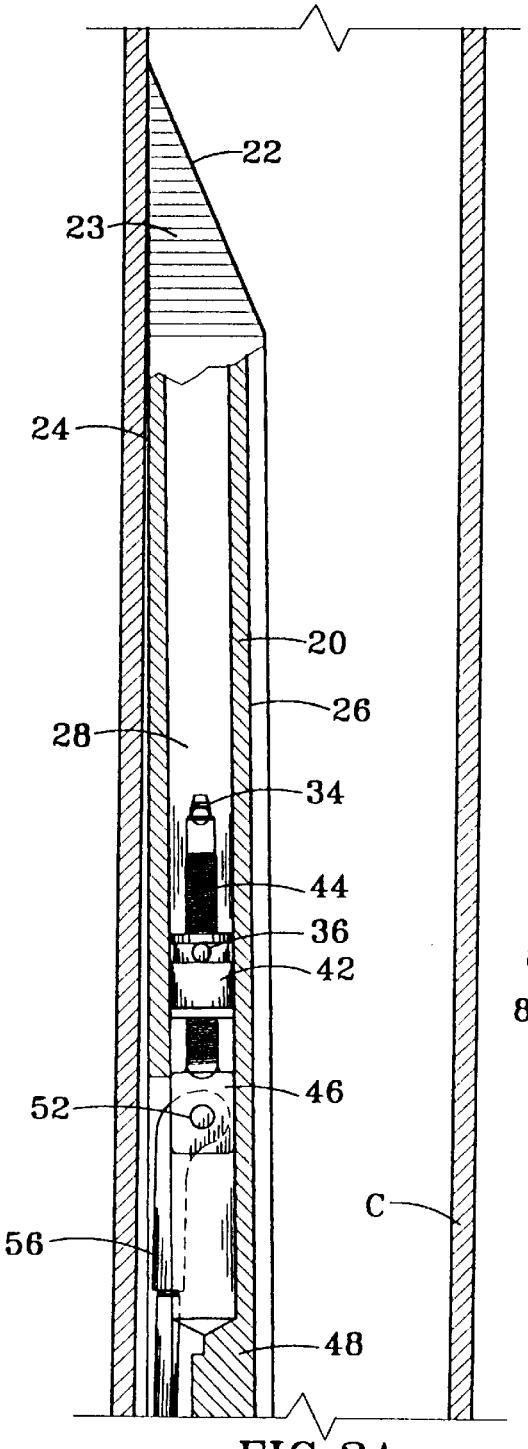
FIGS. 2A, 2B, 2C and 2D illustrate the whipstock assembly in the set position within a casing.
Figure 2B:
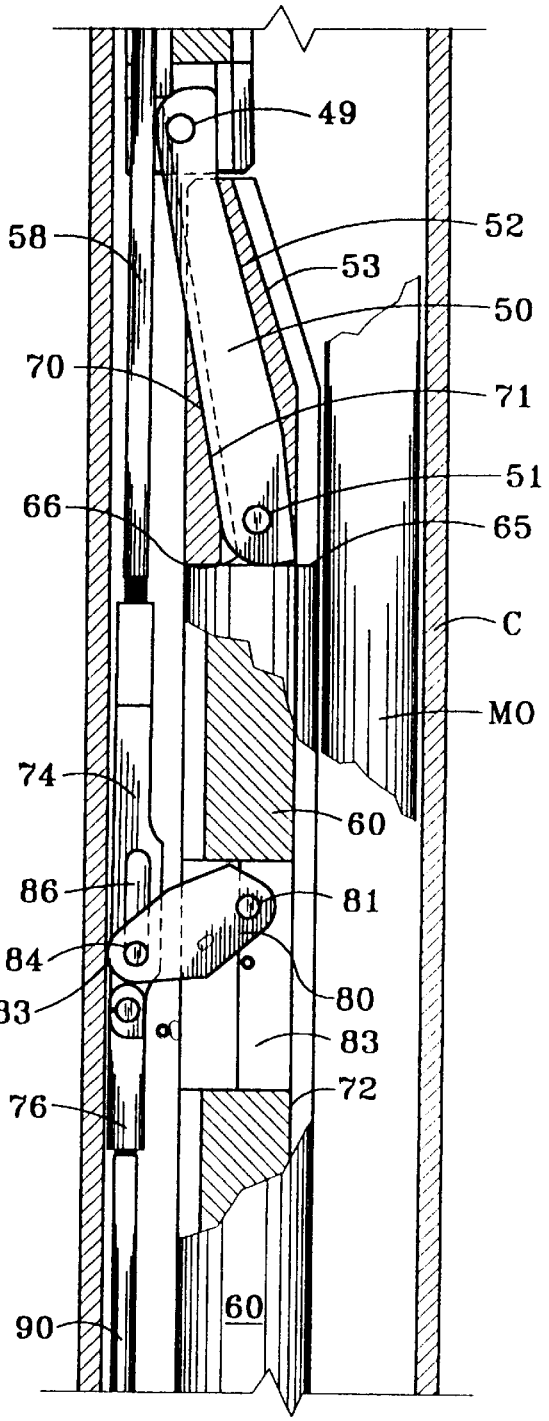
Figure 2C:
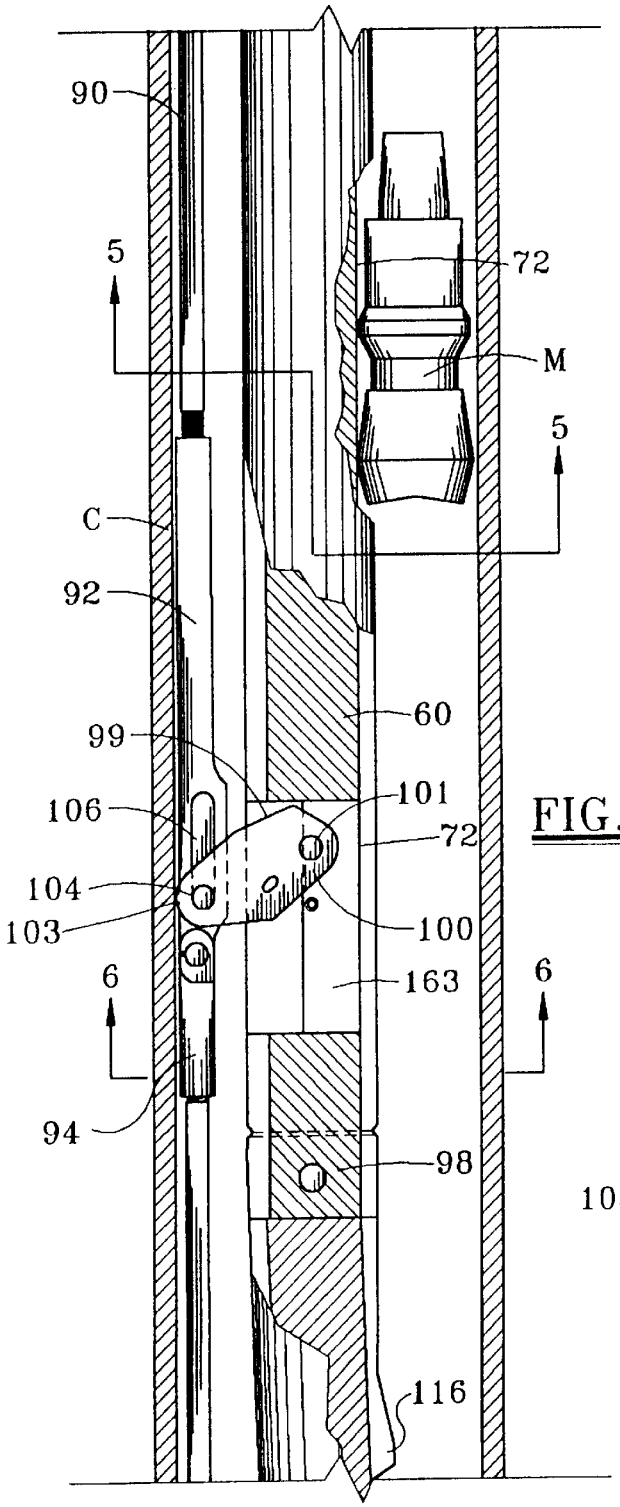
Figure 2D:
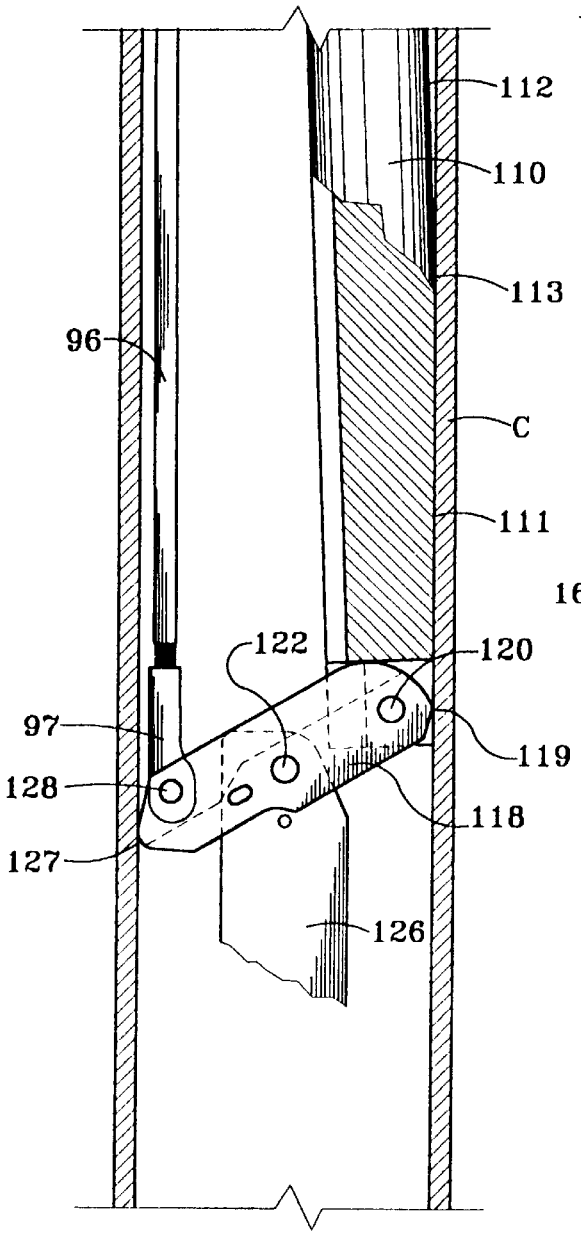

Referring now to FIG. 2A, it should be understood that during this setting operation, the uppermost end of the upper whipstock body 20 normally rests against the "low side" of the casing C. In a typical application, the window may be drilled on the "high side" of the casing. It should be remembered that the casing C in which the whipstock assembly is set in most applications is not truly vertical, and thus the affects of gravity acting on the whipstock assembly normally tends to keep the whipstock assembly against the low side of the casing, which is the left side of the casing shown in FIGS. 2A–2D. The back side 24 of at least the uppermost end of the upper whipstock body 20 may be machined for providing planar engagement with the ID of the casing, as discussed above. Preferably the lowermost end of the upper whipstock body 20 will be spaced slightly from the low side of the casing, as shown in FIGS. 2A and 2B, thereby ensuring the reliable setting of the whipstock assembly 10 to accommodate tolerance variations in the various components of the whipstock assembly.

During the upward movement of the rod 16, the ratchet rod 44 moves upward with respect to the retainer and sleeve subassembly 42, moving from the position as shown as in FIG. 1B to the position as shown in FIG. 2A. The ratchet assembly 40 functions to ensure that the whipstock assembly is retained in the set position by preventing any downward movement of the rod 58 with respect to the upper whipstock body 20. Once the whipstock assembly 10 is fully set, further upward force applied to the rod 16 will shear the stud 34, thereby separating the rod 16 from the ratchet mandrel 44. Once the stud 34 shears, the hydraulic setting tool including the rod 16, the sleeve 14 and the connector 30 may be retrieved to the surface by raising the work string, thereby leaving the whipstock assembly set in the well.

Figure 5:
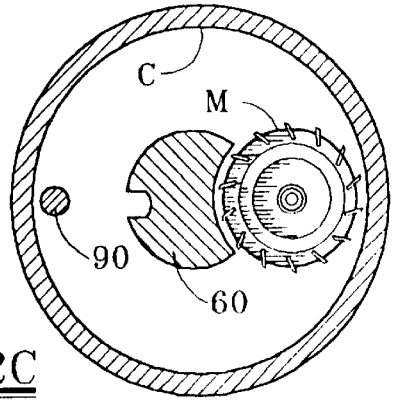
FIG. 5 is a cross section taken along lines 5—5 in FIG. 2C.

A work string may then be used to lower a cutting mill in a well to drill the window in the casing. The cutting mill will similarly be influenced by gravity, and will typically thus first engage initial ramp surface 22 on the upper whipstock body 20 as shown in FIG. 2A. Further downward movement of the cutting mill will move the cutting mill along the upper whipstock body concave surface 26, which may have a slight taper of approximately 3° degrees with respect to the central axis of the casing string. Once the cutting mill is lowered to reach the lowermost end of the upper whipstock body, the mill will be forced toward the high side of the casing as it moves along the ramp surface 52 of the upper member 50 and the parallel ramp surface 53 of the middle whipstock body 60. A particular feature of the present invention is that the concave guiding surface 72 of the middle whipstock body 60 preferably is not tapered with respect to the central axis of the casing, and accordingly this concave surface is a straight concave surface with no taper. The cutting mill may be then lowered along the middle whipstock body with the concave guiding surface 72 of the middle whipstock body retaining the mill trapped between the middle whipstock body and the casing C as shown in FIG. 5. The length of the middle whipstock body 60 is preferably controlled so that at least a portion of the downhole motor MO as shown in FIG. 2B is also effectively trapped between the middle whipstock body and the casing. The downhole motor MO thus typically has a diameter slightly less than the diameter of the mill M, and preferably both the mill M and at least a portion of the downhole motor MO which may be used to rotate the mill are effectively trapped between the concave guiding surface 72 the middle whipstock body and the casing C. This trapping of the motor is substantially reduces any likelihood of the mill rotating out of engagement with the concave surface 72. The motor and the mill may thus be lowered in the well until the mill M engages the lug 116 on the lower whipstock body 110. Engagement of the mill M with the lug 116 may be sensed at the surface since further lowering of the work string is not possible. Once the operator senses that the mill has engaged a lug 116, the operator may raise the mill a short distance, e.g. 2 feet, so that the mill is positioned along the guiding surface 72 of the middle whipstock body. The mill is preferably not raised any further than necessary to ensure that the mill is positioned along a lower end of the middle whipstock body 60, since preferable the motor MO is also trapped between an upper end of the middle whipstock body and the casing. At this stage, hydraulic fluid may be pumped downhole to activate the motor MO, thereby initiating rotation of the cutting mill M. The cutting mill M will thus begin rotating with both the mill and the motor being effectively trapped between the middle whipstock body 60 and the casing. While the mill is rotating, the work string may be lowered to bring the rotating mill to engagement with the lug 116, thereby commencing cutting of the window. Those skilled in the art will appreciate that the lug 116 serves to begin cutting of the window in the casing and prevents the mill from merely cutting into the whipstock body. Once an initial hole has been made in the casing, the rotating mill is lowered and as it is lowered the window is widened and lengthened as the mill moves downward along the inclined face 112 of the lower whipstock body 110. The inclination of the concave diversion face of the lower whipstock body may vary, but in a typical application may be approximately 3° degrees.

Once the mill M has completely formed the window in the casing, another mill may be lowered in the well from a work string to pass through the window cut in the casing and begin drilling a lateral into the formation. The set whipstock assembly 10 thus serves to guide both the mill which cuts the window and the mill which extends the lateral into the formation during a side tracking operation.

Depending on the desires of the operator, the set whipstock assembly may be retained in the set position in the well. Alternatively, however, the whipstock assembly may be unset and retrieved to the surface through the restriction, such as the small diameter tubing T. The retrieval of the whipstock assembly 10 may be accomplished by positioning the lower end of a retrieving tool within the bore 28 of the upper whipstock body 20, as shown in FIG. 1. An upward force on the whipstock body 20 may then shear the pin 36, thereby effectively disabling the ratchet assembly 42 which retained the whipstock body in the set position. Upward movement of the upper whipstock body 20 will thus effectively collapse the set whipstock assembly, returning the whipstock assembly to the run in position. The whipstock assembly may then be retrieved while in the run in position to the surface through the tubing string T. Those skilled in the art will appreciate that if problems are encountered using a conventional retrieving tool to engage the upper whipstock body 20 as discussed above, an overshot tool or die collar may be lowered to engage the threads 23 on the outside of the upper end of the upper whipstock body, and the overshot tool then used to exert the upward force on the set whipstock assembly to return the whipstock assembly to the run in position for retrieval to the surface.

It should be understood that the length of the upper whipstock body, the middle whipstock body and the lower whipstock body will depend upon the desires of the operator. In a exemplary application, the upper whipstock body 20 may have an axially length of 3 or 4 feet. The middle whipstock body 60 may have an axial length of from 12 to 20 feet, and the lower whipstock body may have an axial length of from 20 to 40 feet. Those skilled in the art will appreciate that a fill length of the middle whipstock body and the lower whipstock body are not shown in the figures since a complete showing of each of these whipstock bodies is not necessary for an understanding of the invention. It is preferred, however, that the middle whipstock body 60 have a length of at least twelve feet so that the mill may be raised out of engagement with the lug on the lower whipstock body, as explained above, with both the mill and at least a portion of the downhole motor still trapped by the guiding surface 72 on the middle whipstock body. In one embodiment of the invention, a sleeve may be provided at an upper end of the downhole motor, with this sleeve having a diameter of approximating the diameter the cutting mill. For this application, the length of this upper middle whipstock body thus would typically have to be much longer than twelve feet to ensure that both the mill and the sleeve at the upper end of the motor were in engagement with the guiding surface 72 of the middle whipstock body when initiating rotation of the cutting mill. In other applications, guide pads or sleeves may be positioned at a lower end of the downhole motor, and for these applications the length of the middle whipstock body may be reduced.

In a preferred embodiment to the invention, the lower hinge 118 as shown in FIG. 2D not only positions the lower whipstock body into engagement with the casing C, but also acts to stabilize the lower end of the whipstock body by engaging the casing at a location circumferentially opposite the location where the window will be cut. The rear surface 127 on the lower pivot member 1 18 thus essentially forces the lower end of the whipstock body 110 into engagement with the casing. Since the ratchet assembly 40 does not allow the rod 96 to move downward when the whipstock assembly is in the set position, the lower pivot member 118 effectively acts as a cam to force the lower end of the whipstock body into engagement with the casing, thereby stabilizing the position of the lower whipstock body 110 within the casing. Also, the opposing end 119 of the lower pivot member 118 may also engage the casing to further stabilize the lower pivot member 118 when in the set position. In a less preferred embodiment, the set anchor 150 in the well may provide sufficient rigidity to maintain the lower end of the lower whipstock body 110 in engagement with the casing when the rod 96 is pulled upward, so that the pivot member 118 need not engage the casing.

During the above discussion of the operation of the whipstock assembly, it was noted that a component, such as the lower pivot member 118 or the whipstock positioning members 80, 100, may engage the casing at a location circumferentially opposite the location where the window will be cut. It should be understood that the term "circumferentially opposite" should not be construed to be limited to a location which is 180° degrees opposite the bottom of the concave surface of the lower whipstock body (and thus not necessarily 180° degrees circumferentially opposite the location where the window will be cut). Instead, the term "circumferentially opposite" as used herein is meant in a broader sense to indicate that these components contact a side of the casing which is on the opposing side from where the window will be cut. For example, it should be understood that the rear surface 127 and the lower pivot member 118 may contact the casing at a location 170° degrees opposite the point 113 where the concave surface runs out, but that the surface 127 is nevertheless circumferentially opposite the location where the window will cut. Those skilled in the art will also appreciate that each of the various components which contact the casing at a location opposite the location will where the window will be cut need not have a single surface contact, and instead may use two or more casing contact surfaces which are spaced apart. For example, in another embodiment, the whipstock positioning member 80 may not be a plate like member but instead may have a Y-configuration, so that the two legs of a positioning member straddle the upper middle link with the rearward end of each of these straddle members then engaging the casing at a position which is circumferentially opposite the location where the window will be cut.

The upper hinge member 50 in a preferred embodiment pivotally connects a lower end of the upper whipstock body and an upper end of the lower whipstock body. The upper concave surface 53 on the middle whipstock body, when moved to the set position, effectively serves as an extension of the ramp surface on the upper body for guiding the cutting mill into position along the guiding surface 72 of the middle whipstock body. Other arrangements may be used for initially positioning the cutting mill and subsequently the motor along the guide surface 72 of the middle whipstock body. Those skilled in the art will appreciate that various types of setting tools and mechanisms may be used for setting the whipstock assembly, for ensuring that the set whipstock assembly is retained in the set position until it is intentionally released, and for releasing the whipstock assembly to be retrieved to the surface. As previously noted, a setting tool may be used to move a rod upward with respect to a setting sleeve which is engagement with the upper whipstock body, but other arrangements will be readily apparent to those skilled in the art for achieving this purpose. Also, the whipstock positioning member 80 and 100 as discussed herein may be pivotally connected to both the upper end and the lower end of the middle whipstock body. In other arrangements, a single positioning member rather than two positioning members may be employed, or three or more positioning members could be utilized. If two positioning members are utilized, the lower positioning member could alternatively be provided at an upper end of a lower whipstock body. Also, these positioning members may be moved to a set position by components other than by movement of a rod responsive to a setting tool. For example, positioning members could be hydraulically actuated to move from the run in position to the set position, and then released to return to the run in position.

Offset centralizers could be used to position the whipstock upper body against the casing at a location opposite where the window will be cut if gravity cannot be relied on for this function. The cutting mill and the motor may have similar offset centralizers to ensure that the mill, when lowered in the well, engages the whipstock upper body so that it enters and is trapped between the middle whipstock body and the casing. While the invention has been particularly desired for embodiments wherein the mill is powered by a downhole motor, the whipstock assembly may also be used to guide a mill which is rotating by rotating a drill string at the surface to turn the mill.

The foregoing disclosure and description of the invention are thus explanatory of preferred embodiments. It would be appreciated by those skilled in the art that various changes in the size, shape and materials, as well as in the details of the illustrated construction and system, the combination of features, and the methods as discussed herein may be made without departing from the invention. Although the invention has thus been described in detail for various embodiments, each should be understood that this explanation is for illustration, and the invention is not limited to these embodiments. Modifications to the apparatus and methods as described herein will be apparent to those skilled in the art in view of this disclosure. Such modifications may be made without departing from the invention, which is defined by the claims.

What is claimed is:

1. A whipstock assembly for setting within a casing on an anchor for securing the set whipstock assembly within the casing after having passed the whipstock through a restriction positioned above the location where the whipstock assembly is to be set, the whipstock assembly being set within the casing to divert a cutting mill to cut a window in the casing, the whipstock assembly comprising:

a lower whipstock body having a concave whipstock diversion face for diverting the cutting mill to cut the window in the casing;

a lower hinge member at a lower end of the lower whipstock body for pivoting the lower whipstock body from a run in position for passing the whipstock assembly through the restriction to a set position for positioning the concave whipstock diversion face for diverting the cutting mill;

a middle whipstock body above the lower whipstock body, the middle whipstock body moveable relative to the lower whipstock body from a run in position for passing the whipstock assembly through the restriction to a set position, the middle whipstock body having a concave guiding face for guiding the cutting mill when in the set position;

a whipstock positioning member above the lower hinge member for moving from a run in position for passing the whipstock assembly through the restriction to a set position for positioning the middle whipstock body guiding face for guiding the cutting mill, the whipstock positioning member having a casing engaging surface for engaging the casing when in the set position at a location circumferentially opposite the location where the window will be cut; and an upper whipstock body positioned above the middle whipstock body, the upper whipstock body movable relative to the middle whipstock body from a run in position for passing the whipstock assembly through the restriction to a set position, the upper whipstock body having an upper body ramp surface for moving the cutting mill when in the set position into engagement with the middle whipstock body guiding face.

2. The whipstock assembly as defined in claim 1, wherein the middle whipstock assembly concave guiding face has a substantially zero degree taper when the middle whipstock body is in the set position, thereby trapping the mill between the casing and the concave guiding face.

3. The whipstock assembly as defined in claim 1, further comprising:

an upper hinge member pivotally connecting a lower end of the upper whipstock body and an upper end of the middle whipstock body; and the upper hinge member movable with respect to the middle whipstock body from a run in position to a set position for radially spacing the middle whipstock body guiding face from the upper whipstock body ramp surface.

4. The whipstock assembly as defined in claim 1, further comprising:

another whipstock positioning member above the lower hinge member for moving from a run in position for passing the whipstock assembly through the restriction to a set position for positioning the middle whipstock body guiding face for guiding the cutting mill, the another whipstock positioning member having another casing engaging surface for engaging the casing when in the set position at a location circumferentially opposite the location where the window will be cut.

5. The whipstock assembly as defined in claim 4, further comprising:

each of the whipstock positioning member and the another whipstock positioning member are pivotally connected to the middle whipstock body; and an elongate rod axially moveable relative to the lower whipstock body for moving the whipstock positioning member from the run in position to the set position.

6. The whipstock assembly as defined in claim 5, wherein the elongate rod moves both the lower hinge member and the another whipstock positioning member form the run in position to the set position.

7. The whipstock assembly as defined in claim 1, wherein the lower hinge member when in the set position moves a portion of the lower end of the lower whipstock body into engagement with the casing.

8. The whipstock assembly as defined in claim 7, wherein the lower hinge member includes a lower hinge member engaging surface for engagement with the casing when in the set position at a location circumferentially opposite where the window will be cut.

9. The whipstock assembly as defined in claim 1, wherein of the concave guiding face on the middle whipstock body is sufficiently long such that both the cutting mill and at least a portion of a downhole motor for rotating the cutting mill are guided by the middle whipstock body concave guiding face during rotation of the cutting mill.

10. The whipstock assembly as defined in claim 1, wherein the whipstock body includes a retrieval surface for engagement with a retrieval tool to retrieve the whipstock assembly to the surface.

11. The whipstock assembly as defined in claim 1, further comprising:

a stop member for preventing movement of the whipstock positioning member with respect to the middle whipstock body when in the set position.

12. A method of cutting a window in a casing after passing a whipstock assembly through a restriction in a well bore, the whipstock assembly being movable from a run in position for passing through the restriction to a set position for anchoring the whipstock assembly within the casing to divert a cutting mill to cut a window in the casing, the method comprising:

providing a whipstock assembly having a lower whipstock body with a concave whipstock diversion face, a middle whipstock body movable relative to the lower whipstock body and having a concave guiding face, and an upper whipstock body movable relative to the middle whipstock body and having a ramp surface;

lowering the whipstock assembly in the wellbore past the restriction while the whipstock assembly is in the run in position;

thereafter anchoring the whipstock assembly within the casing;

pivoting a lower end of the lower whipstock body from a run in position for passing the whipstock assembly through the restriction to a set position for positioning the whipstock diversion face for engagement with the cutting mill to cut the window in the casing;

moving a whipstock positioning member from a run in position for passing through the restriction to a set position for positioning a middle whipstock body guiding face for guiding the cutting mill, the whipstock positioning member engaging the casing when in the set position at a location circumferentially opposite the location where the window will be cut;

moving a lower end of the upper whipstock body relative to an upper end of the middle whipstock body from a run in position for passing through the restriction to a set position for positioning the middle whipstock body guiding face for guiding the cutting mill;

lowering the cutting mill for engagement with the ramp surface on the upper whipstock body;

thereafter lowering the cutting mill to a position axially adjacent the middle whipstock body guiding face;

rotating the cutting mill while positioned axially adjacent the middle whipstock body guiding face; and thereafter lowering the cutting mill into engagement with the lower whipstock body diversion face for cutting the window in the casing.

13. The method as defined in claim 12, further comprising:

pivotally connecting a lower end of the upper whipstock body and an upper end of the middle whipstock body; and moving the middle whipstock body from a run in position to a set position for radially spacing the middle whipstock body guiding face from the upper whipstock body ramp surface.

14. The method as defined in claim 12, further comprising:

raising the cutting mill while positioned axially adjacent the middle body guiding face and thereafter rotating the cutting mill.

15. The method as defined in claim 12, further comprising:

after cutting the window in the casing, retrieving the whipstock assembly to the surface.

16. The method as defined in claim 12, further comprising:

moving another whipstock positioning member from a run in position for passing the whipstock assembly through the tubing string to a set position for positioning the middle whipstock body guiding face for guiding the cutting mill, the another whipstock positioning member engaging the casing when in the set position at a location circumferentially opposite the location where the window will be cut.

17. The method as defined in claim 16, further comprising:

pivotally connecting each of the whipstock positioning member and the another whipstock positioning member to the middle whipstock body.

18. The method as defined in claim 12, further comprises:

engaging each of the lower whipstock body and a lower hinge member with the casing when the whipstock assembly is in the set position.

19. The method as defined in claim 12, further comprising:

moving an elongate rod axially relative to the lower whipstock body for moving each of a lower hinge assembly and the whipstock positioning member from the run in position to the set position.

20. The method as defined in claim 19, further comprising:

activating a setting tool to move the elongate rod; and separating the elongate rod after the whipstock assembly is in the set position; and thereafter retrieving the setting tool to the surface.

21. The method as defined in claim 12, further comprising:

providing a stop for preventing movement of the whipstock positioning member with respect to the middle whipstock body when the whipstock assembly is in the set position.

22. The method as defined in claim 12, further comprising:

lowering the whipstock assembly through a tubing string while in the run in position, the tubing string having an outer diameter less than an inner diameter of the casing in which the whipstock assembly is set, such that the tubing string forms the restriction in the wellbore.

* * * * *